US005415279A

United States Patent [19]

Tan

[11] Patent Number: 5,415,279

[45] Date of Patent: May 16, 1995

[54] SLEEVING DEVICE, KIT, AND METHOD

[75] Inventor: Huey-Ming Tan, Fountain Valley, Calif.

[73] Assignee: Omaga Enterprises, Inc., Anaheim, Calif.

[21] Appl. No.: 290,589

[22] Filed: Aug. 15, 1994

[51] Int. Cl.[6] ..... B65D 77/00; B65D 77/22; B65D 85/00; B65D 85/30

[52] U.S. Cl. ..... 206/216; 206/223; 206/225; 206/397; 206/53; 206/407; 206/408; 206/454; 206/455

[58] Field of Search ..... 206/216, 223, 455, 454, 206/225, 397, 53, 407, 408

[56] References Cited

U.S. PATENT DOCUMENTS

| | | | |
|---|---|---|---|
| 3,698,548 | 10/1972 | Stenzel et al. | 242/588.6 |
| 3,941,246 | 3/1976 | Doden | 206/455 |
| 4,055,933 | 11/1977 | Getsch . | |
| 4,115,981 | 9/1978 | Hell et al. . | |
| 4,553,369 | 11/1985 | Debes et al. . | |
| 4,574,692 | 3/1986 | Wahli . | |
| 4,602,714 | 7/1986 | Ozeki | 206/455 |
| 4,629,070 | 12/1986 | Roberg . | |
| 4,787,766 | 11/1988 | Lorsch . | |
| 4,821,876 | 4/1989 | Novito et al. | 242/71.1 |
| 4,838,435 | 6/1989 | Alexandre et al. . | |
| 4,842,211 | 6/1989 | Robbins | 242/71.1 |
| 4,848,576 | 7/1989 | Stemmer, Jr. | 206/456 |
| 4,911,777 | 3/1990 | Truc et al. . | |
| 4,988,556 | 1/1991 | Nilsen et al. . | |
| 5,000,319 | 3/1991 | Mermelstein . | |
| 5,031,773 | 7/1991 | Manico et al. | 206/455 |
| 5,109,978 | 5/1992 | Cawley | 206/225 |
| 5,179,409 | 1/1993 | Kazami et al. . | |
| 5,226,560 | 7/1993 | Jones | 221/70 |
| 5,275,321 | 1/1994 | Manu et al. | 225/45 |

OTHER PUBLICATIONS

Instruction Manual—(For "S" Series Semi-Automatic Film Sleever); Omaga Enterprises, Inc., Anaheim, California.

Operator's Manual—Model: E N V - M5; Noritsu Film Enveloper.

Manual—4508 Semi Automatic Negative Sleever Manual; Crown Photo Systems, Inc.

*Primary Examiner*—Steven N. Meyers
*Assistant Examiner*—Tara L. Laster

[57] ABSTRACT

A sleeving device includes two side brackets. These brackets are secured to the side edges of a flap of a shipping box that contains a roll of sleeving material. The side brackets each engage a respective side edge of the flap in a respective channel. One of the side brackets further includes a guide that forms a funnel-shaped opening that facilitates the loading of film into the pockets of the sleeving material.

18 Claims, 3 Drawing Sheets 10
12
13
14
15
16
17
18
20
21
22
23
24
25
26
27
28
29
30
32
34
38
54
2
3

SLEEVING DEVICE, KIT, AND METHOD

BACKGROUND OF THE INVENTION

This invention relates to a sleeving device for use with sleeving material to assist a user in loading strips of film into the sleeving material.

Sleeving material is widely used to protect film, including both negative and positive film. In one form, such sleeving material includes a roll of upper and lower sheets that are secured together to define an array of pockets extending across the sheets. Each of these pockets is open at one end. In use, strips of film are inserted into the pockets, typically with the aid of a sleeving machine.

Conventional motor-driven sleeving machines provide automatic indexing of the sleeving material. Such sleeving machines are particularly useful for high-volume applications, where the speed and convenience provided by a motor-driven sleeving machine easily justifies its costs.

In smaller volume applications, there is a need for a simple, reliable, inexpensive sleeving device which facilitates insertion of film into the pockets of the sleeving material.

SUMMARY OF THE INVENTION

According to the method of this invention, a sleeving material box is converted into a sleeving device. First a quantity of sleeving material is provided, comprising an array of pockets shaped to receive film. The sleeving material is contained in a box having a flap having first and second opposed edges. The box is opened to extend the flap away from the box, and first and second side brackets are positioned at the first and second edges of the flap to hold the flap in a selected, substantially rigid configuration. One of the side brackets comprises a guide shaped to facilitate loading of film into the pockets of the sleeving material.

This invention is also directed to a sleeving device comprising side brackets as described above and a sleeving material box in assembled relationship, and to a kit for converting a sleeving material box into a sleeving device.

DETAILED DESCRIPTION OF THE PRESENTLY PREFERRED EMBODIMENTS

Figure 1:
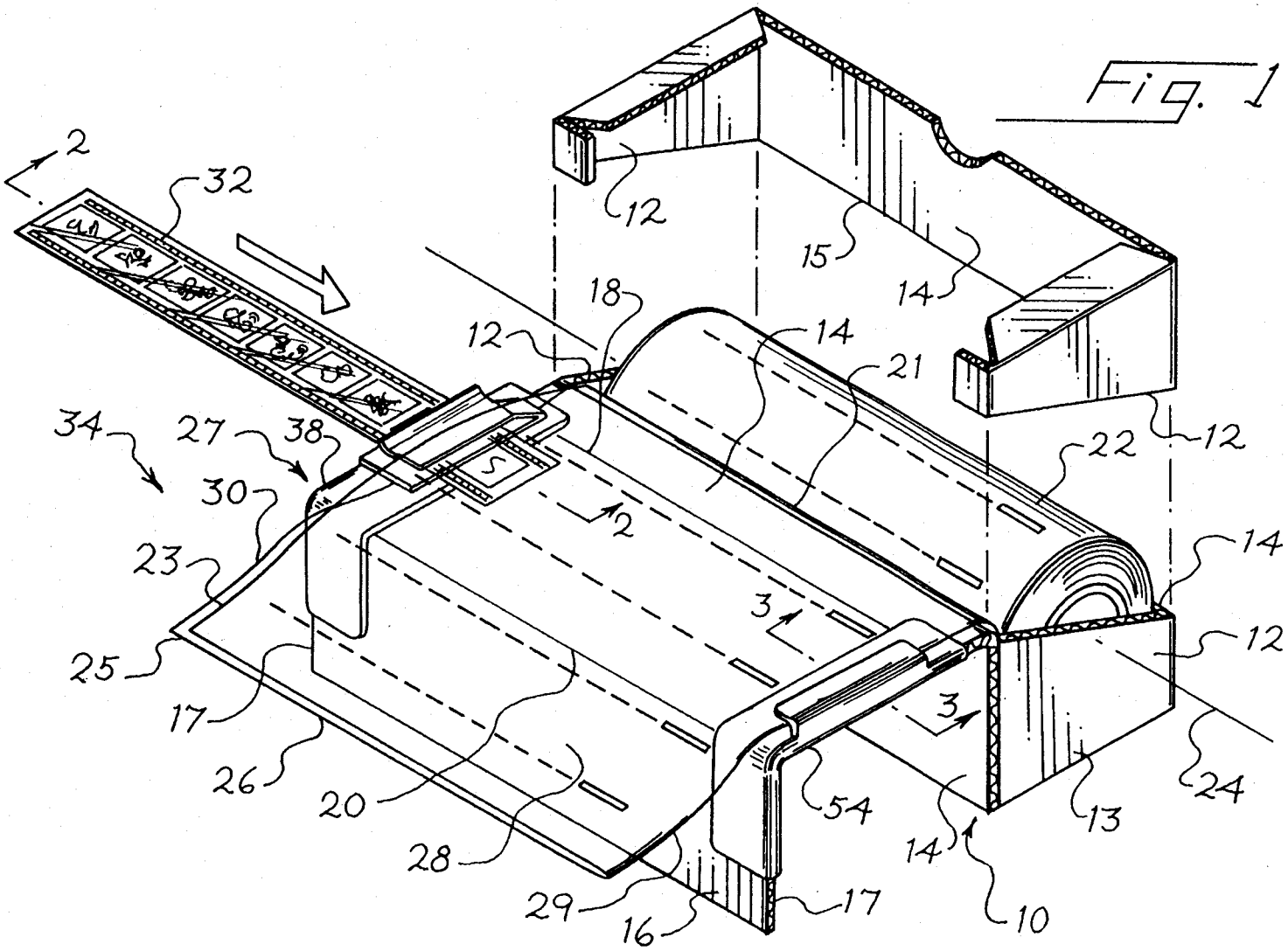
FIG. 1 is a perspective view of a sleeving device which incorporates a presently preferred embodiment of this invention.

Turning now to the drawings, FIG. 1 shows a perspective view of a preferred embodiment of the sleeving device of this invention. This sleeving device utilizes a shipping box 10 for a roll of sleeving material 22.

The shipping box 10 may be formed of paperboard or the like and includes end panels 12 interconnected by side panels 14 and a bottom panel 13. A flap 16 is secured to one of the side panels 14 at a fold line 18, and this flap 16 defines two parallel side edges 17, each having one end adjacent to a respective one of the end panels 12. The flap 16 defines a fold line 20 at an intermediate portion of the flap, and the adjacent side panel 14 defines a fold line 21. The fold line 20 allows the flap 16 to be folded within the opposed side wall 14 when closed, and the fold line 21 allows the adjacent side panel 14 to be folded to the opened position shown in FIG. 1. The fold line 20 also serves to define two separate surfaces on the flap 16. The surface of the flap between the fold lines 20 and 18 becomes a horizontal work surface. The surface between the fold line 20 and the end of the flap 16 opposite the fold line 18 becomes a vertical support leg for the work surface. In the opened position of FIG. 1, the flap 16 is folded by 180° along the fold line 20 with respect to the closed position. The box 10 is perforated along a perforation line 15. As shown in FIG. 1, the user can tear off the top part of the box 10 along the line 15 to enhance the appearance of the box 10 as a sleeving device and to facilitate easy removal and replacement of the sleeving material roll.

The sleeving material 22 can be of a conventional type having a roll axis 24 that extends the end panels 12, parallel to the side walls 14. The sleeving material has a free end 26, and it includes upper and lower sheets 23, 25 that define an array of pockets 28. Each of the pockets 28 is oriented to extend across the width of the sleeving material 22 from a first edge 27 to a second edge 29. Each pocket 28 defines an opening 30 at the first edge 27 of the sleeving material 22. These pockets 28 are each sized to receive a strip of film 32, which can be positive or negative as desired. The sleeving material 22 is divided by perforations into individual sheets which are initially interconnected to form a roll. In FIG. 1, the free end 26 is formed at one of the perforations. Copending U.S. patent application Ser. No. 08/188,588 describes one suitable sleeving material.

As explained above, in the past it has been conventional to remove a roll of sleeving material 22 from the box 10 and install it in a motor-driven sleeving machine. This invention provides a simpler solution to the problem of facilitating the loading of film into the pockets 28 of the sleeving material 22.

In this embodiment, a sleeving device 34 is provided which utilizes portions of the box 10. The sleeving device 34 includes a first side bracket 38 and a second side bracket 54.

Figure 2:
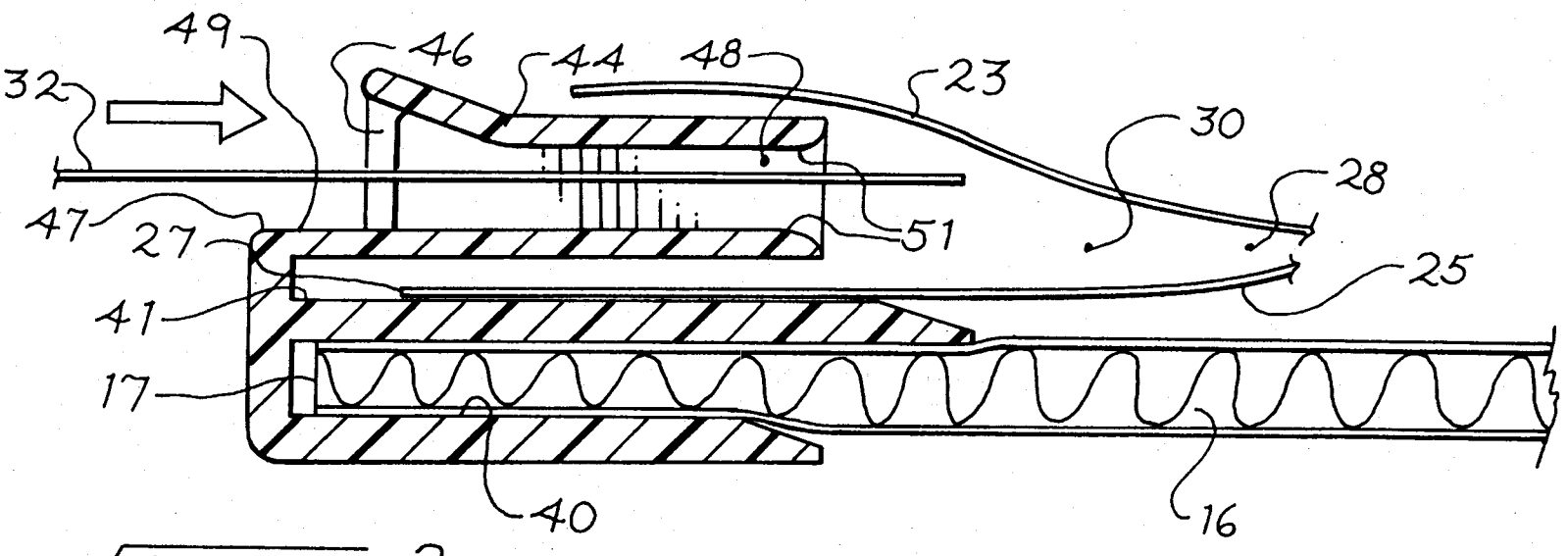
FIG. 2 is a cross-sectional view taken along line 2—2 of FIG. 1.
Figure 5:
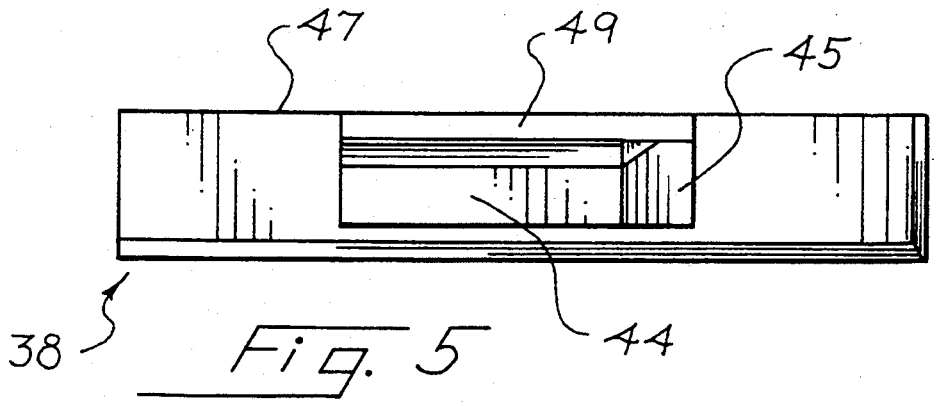
FIG. 5 is a top view of the first side bracket of FIG. 4.
Figure 4:
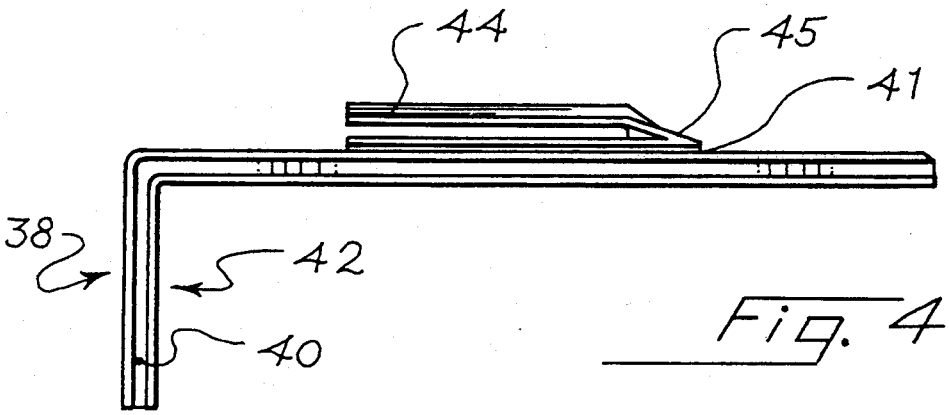
FIG. 4 is a side elevational view of a first side bracket of FIG. 1.

The first side bracket 38 is shown in greater detail in FIGS. 2, 4 and 5. This bracket 38 includes a first channel 40 sized to receive one of the side edges 17 of the flap 16, and a second channel 41 sized to receive the first edge 27 of the lower sheet 25 of sleeving material to allow free sliding of the sleeving material along the channel 41. The channel 40 in this embodiment forms a right angle to define a leg 42 at one end of the channel 40. A guide 44 is included in the bracket 38, superimposed above a central portion of channel 40. As best shown in FIG. 2, this guide 44 defines an entrance 46 and an exit 48. The entrance 46 is wider than the exit 48, and therefore the guide 44 functions as a funnel. In this embodiment the guide 44 is connected to the remainder of the bracket 38 only at an end portion 45 opposite the leg 42. The exit 48 is shaped to be positioned immediately adjacent to the openings 30 of the pockets 28 in the sleeving material, between the upper and lower sheets 23, 25, as shown in FIG. 2.

Figure 3:
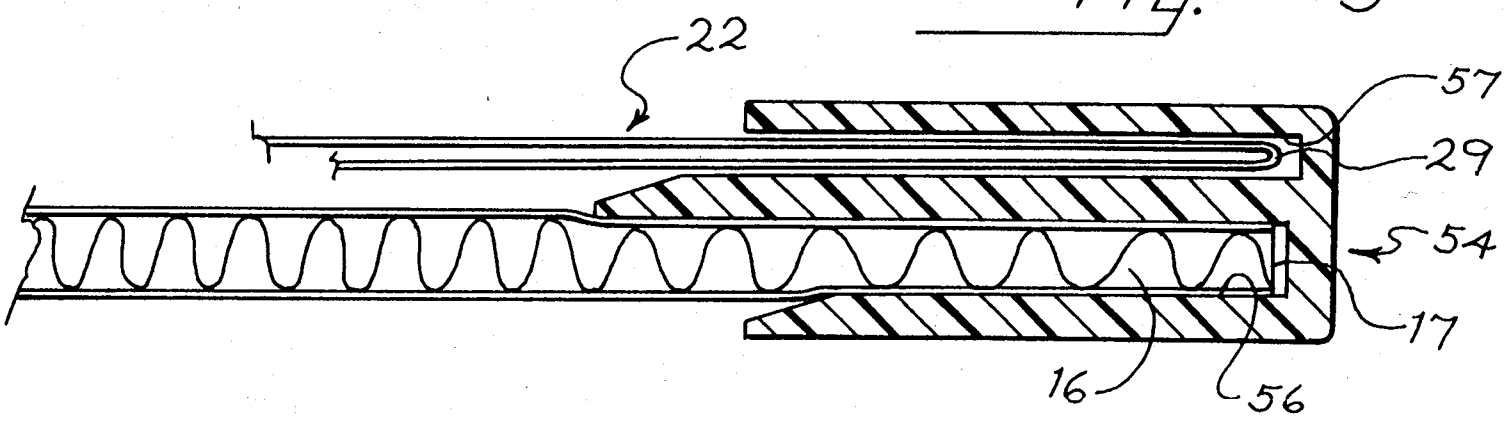
FIG. 3 is cross-sectional view taken along line 3—3 of FIG. 1.
Figure 7:
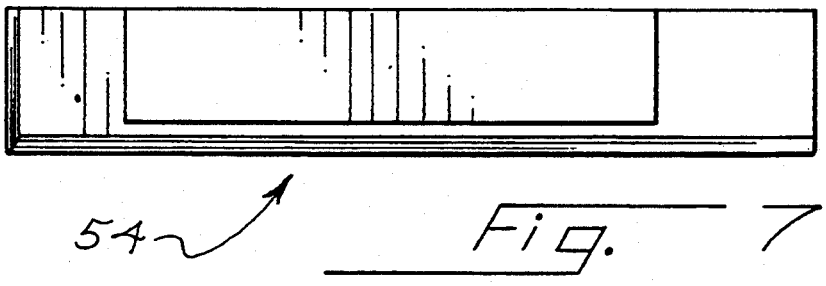
FIG. 7 is a top view of the second side bracket of FIG. 6.
Figure 6:
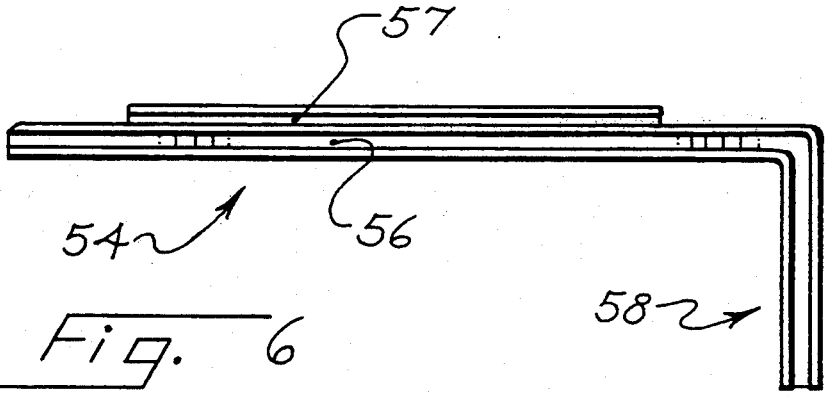
FIG. 6 is a side elevational view of a second side bracket of FIG. 1.

FIGS. 3, 6 and 7 show detailed views of the second side bracket 54. The side bracket 54 includes a first channel 56 which is sized to receive one of the side edges 17 of the flap 16, and a second channel 57 sized to receive the second edge 29 of the sleeving material 22 to allow free sliding of the sleeving material along the channel 57, as shown in FIG. 3. The lower edge of the first channel 56 is chamfered to facilitate insertion of the flap 16 into the channel 56. The first channel 56 also forms a right angle to define a leg 58.

The side brackets 38, 54 are used to convert the box 10 into a sleeving device 34. First, the flap 16 is opened to the position shown in FIG. 1. The first and second side brackets 38, 54 are then installed on the flap 16 with the side edges 17 received in the channels 40, 56 and the legs 42, 58 adjacent the free end of the flap 16. The side brackets 38, 54 are held in place on the flap 16 by friction.

Once fully assembled, the side brackets 38, 54 hold the flap 16 in a rigid, fixed configuration as shown in FIG. 1. The free end 26 of the sleeving material 22 is then positioned on the flap 16. As shown in FIGS. 2 and 3, the first and second edges 27, 29 are slidingly received in the second channels 41, 57, respectively, and the exit 48 of the guide 44 is positioned in alignment with the openings 30 in the pockets 28, between the upper and lower sheets 23, 25. The side brackets 38, 54 guide the sleeving material 22 and prevent it from sliding laterally on the flap 16. The end portion 45 of the guide 44 (FIG. 4) is ramped to assist in avoiding misthreading as the sleeving material 22 is fed into position on the side bracket 38. A user can then grasp the free end 26 of the sleeving material 22 centrally in order to advance the sleeving material 22 until a next one of the pockets 28 is in alignment with the guide 44.

As shown in FIG. 2, the guide 44 holds the upper and lower sheets 23, 25 apart to facilitate the insertion of film into the pockets 28. The user can then insert a strip of film 32 into the entrance 46 of the guide 44 and via the guide 44 into the aligned pocket 28. The entrance 46 is offset inwardly from the side 47 of the side bracket 38, thereby creating a ledge 49 that facilitates film alignment. The inner edges 51 of the guide 44 are smoothly rounded to avoid scratches on the film as it is inserted. When a sufficient number of the pockets 28 have been filled, the filled portion of the sleeving material 22 can be removed from the remaining roll portion by separating perforations formed in the sleeving material 22.

The side brackets 38, 54 preferably hold the upper portion of the flap 16 in a substantially horizontal position, with the end of the flap 16 coplanar with the bottom panel 13. With this arrangement the sleeving device 34 can be used with the flap either extending toward the user or away from the user. This facilitates both right-handed and left-handed use of the sleeving device 34.

The sleeving device 34 provides a number of important advantages. Because it utilizes the box 10, sleeving device 34 is of extremely low cost. The side brackets 38, 54 can readily be shipped as two relatively compact elements, and then assembled on site by the user. The side brackets 38, 54 can be readily removed from one box 10 and installed on another as needed. The rigidified flap 16 forms a stable working surface, and the guide 44 assists the user in aligning the film with the openings in the pockets. Because the side edges 17 of the flap 16 are captured in the first channels 40, 56, flexing of or warping of the flap 16 is almost completely eliminated.

Simply by way of example, the side brackets 38, 54 can be injection molded of a suitable plastic material, or alternately they can be formed from sheet metal.

Of course, it should be understood that a wide range of changes and modifications can be made to the preferred embodiment described above. For example, the sleeving device can be modified to include a greater or lesser number of separate brackets, and a center bracket interconnecting the side brackets can be used if desired. The legs 42, 58 are not required in all embodiments, and the first channels 40, 56 can be rectilinear if desired. The sleeving material 22 can be arranged as a folded stack or as separate sheets rather than a roll as shown. Also, the guide 44 can be positioned on either of the side brackets 38, 54, or if desired, two guides can be provided, one on each of the side brackets 38, 54.

It is therefore intended that the foregoing detailed description be regarded as an illustration of only one form of the invention. It is the following claims, including all equivalents, which are intended to define the invention.

I claim:

1. A method for converting a sleeving material box into a sleeving device comprising the following steps:

a) providing a quantity of sleeving material contained in a box, said box comprising a flap comprising first and second opposed side edges, said sleeving material comprising an array of pockets shaped to receive film;

b) opening the box to extend the flap away from the box; and c) positioning first and second side brackets at the first and second side edges, respectively, to hold the flap in a selected, substantially rigid configuration, one of said side brackets comprising a guide shaped to facilitate loading of film into the pockets of the sleeving material.

2. The method of claim 1 wherein the first and second side brackets each comprise a respective channel, and wherein step c) comprises the component step of:

c1) positioning the first and second side edges of the flap into the channels of the respective side brackets.

3. The method of claim 2 wherein the first and second side brackets each comprise a respective additional channel, and wherein the method comprises the following additional step:

d) positioning at least a portion of the sleeving material in the additional channels.

4. The method of claim 2 wherein the side brackets each comprise a respective leg, and wherein the channels extend into the respective legs.

5. The method of claim 1 wherein the flap is substantially horizontal in the selected configuration.

6. A sleeving device for assisting a user to load film into pockets of a sleeving material, said sleeving device comprising:

a sleeving material box comprising two opposed end panels interconnected by a plurality of side walls, and a flap connected to one of the side walls and movable between a closed position extending between the end panels, and an opened position, said flap comprising first and second side edges;

first and second side brackets removably secured to the first and second side edges, respectively, to hold the flap in a selected, substantially rigid configuration, at least one of said side brackets comprising a guide shaped to facilitate loading of film into pockets of a sleeving material placed in the box and extending over the flap adjacent the side brackets.

7. The invention of claim 6 wherein the side brackets each comprise a respective channel that removably receives the respective side edge of the flap.

8. The invention of claim 7 further comprising a quantity of sleeving material in the box, said sleeving material comprising an array of pockets oriented parallel to an axis extending between the end panels, said sleeving material having a free end overlying the flap, said sleeving material comprising openings at one end of the pockets, one of said openings aligned with the guide.

9. The invention of claim 8 wherein each of the side brackets comprises an additional channel, and wherein the sleeving material is slidingly received in the additional channels.

10. The invention of claim 7 wherein the sleeving material comprises upper and lower sheets disposed on respective sides of the guide.

11. The invention of claim 10 wherein the guide defines a closed end adjacent the box and an open end remote from the box.

12. The invention of claim 7 wherein the sleeving material is in roll form, and wherein perforations divide the sleeving material into sheets.

13. The invention of claim 6 wherein the side brackets each comprise a respective leg.

14. The invention of claim 13 wherein the side brackets each comprise a respective channel that removably receives the respective side edge of the flap, and wherein the channels extend into the legs to hold the flap in a folded configuration.

15. A kit for converting a sleeving material box into a sleeving device, said kit comprising:

a first and second side brackets each comprising a respective first channel sized to receive and frictionally engage a respective side of a flap of a sleeving material box, and a respective second channel overlying the respective first channel and sized to receive a respective edge of a sleeving material, said first side bracket further comprising a guide overlying the respective second channel and shaped to facilitate loading of film into pockets of the sleeving material.

16. The invention of claim 15 wherein the guide comprises a closed end and an opposed open end.

17. The invention of claim 15 wherein the side brackets each comprise a respective leg.

18. The invention of claim 17 wherein the first channels extend into the respective legs to hold the flap in a folded configuration.

* * * * *